US008550269B2

(12) United States Patent
Lane

(10) Patent No.: US 8,550,269 B2
(45) Date of Patent: Oct. 8, 2013

(54) DRINK BOTTLE AND LID WITH COVER FOR DRINK SPOUT

(75) Inventor: Marvin Lane, Round Lake Beach, IL (US)

(73) Assignee: Thermos L.L.C., Schaumburg, IL (US)

( * ) Notice: Subject to any disclaimer, the term of this patent is extended or adjusted under 35 U.S.C. 154(b) by 0 days.

(21) Appl. No.: 13/155,512

(22) Filed: Jun. 8, 2011

(65) Prior Publication Data

US 2012/0312832 A1 Dec. 13, 2012

(51) Int. Cl.

| | |
|---|---|
| ***A47G 19/22*** | (2006.01) |
| ***B65D 41/56*** | (2006.01) |
| ***B65D 25/28*** | (2006.01) |
| ***B65D 51/18*** | (2006.01) |
| ***B65D 25/40*** | (2006.01) |

(52) U.S. Cl.

USPC ..... 215/229; 220/215.5; 220/254.3; 220/708; 222/568

(58) Field of Classification Search

USPC ..... 220/212.5, 212, 710.5, 708, 709, 220/705, 254.3, 254.1, 284, 259.1, 256.1; 215/229, 228, 388, 200; 222/568, 567, 566, 222/200

IPC ..... B65D 25/28, 41/56, 51/18, 51/00, 5/72, B65D 25/42, 25/40; A47G 19/22

See application file for complete search history.

(56) References Cited

U.S. PATENT DOCUMENTS

| | | | |
|---|---|---|---|
| 3,757,979 | A | 9/1973 | Berghahn |
| 3,944,101 | A | 3/1976 | Landen et al. |
| 4,742,928 | A | 5/1988 | Braun |
| 5,203,468 | A | 4/1993 | Hsu |
| 5,213,236 | A | 5/1993 | Brown et al. |
| 5,244,113 | A | 9/1993 | Stymiest |

(Continued)

FOREIGN PATENT DOCUMENTS

| | | | |
|---|---|---|---|
| DE | 4117220 | C1 | 5/1992 |
| DE | 102006060143 | B3 | 7/2008 |

(Continued)

OTHER PUBLICATIONS

Thermos catalog of Kids Lunch Kits and Food Storage, 2007, page showing Thermos FUNtainer bottle and lid, item 24227BA 006 and four photographs showing the FUNtainer lid.

(Continued)

*Primary Examiner* — Robert J Hicks
(74) *Attorney, Agent, or Firm* — Schiff Hardin LLP

(57) ABSTRACT

A drink bottle with a removable lid includes an inner lid attached to the mouth of the bottle and an outer lid or cover pivotably mounted on said inner lid. A drink spout extends from the inner lid. The outer lid or cover may be locked into a closed position covering the drink spout. A push button release is activated to unlock the outer lid and permit the outer lid to pivot to a position exposing the drink spout for access by a user. The outer lid may be snapped of the inner lid by moving the outer lid beyond an open position. A bail handle on the outer lid is retained in a stowed position in a recess in the outer lid or is moved to a deployed position. The bail handle disconnects from the outer lid when moved beyond the deployed position. The push button for releasing the closed outer lid is enclosed within a tunnel in the inner lid.

16 Claims, 11 Drawing Sheets

(56) References Cited

U.S. PATENT DOCUMENTS

| | | | | |
|---|---|---|---|---|
| 5,282,541 | A * | 2/1994 | Chen | 215/229 |
| D436,862 | S | 1/2001 | Witt et al. | |
| 6,279,773 | B1 * | 8/2001 | Kiyota | 220/709 |
| D451,392 | S | 12/2001 | Kitamura et al. | |
| D455,611 | S | 4/2002 | Kitamura et al. | |
| D463,280 | S | 9/2002 | Brozell | |
| 6,484,895 | B2 | 11/2002 | Montgomery et al. | |
| D514,446 | S | 2/2006 | Choi | |
| D524,650 | S | 7/2006 | Sitomer | |
| D529,339 | S | 10/2006 | Carreno et al. | |
| D538,110 | S | 3/2007 | Kitamura et al. | |
| D547,607 | S | 7/2007 | Forsman | |
| D571,147 | S | 6/2008 | Rohe | |
| D586,184 | S | 2/2009 | Miller et al. | |
| D589,743 | S | 4/2009 | Pearson | |
| D590,661 | S | 4/2009 | Kitamura et al. | |
| D592,012 | S | 5/2009 | Carreno | |
| D596,460 | S | 7/2009 | Nezu | |
| D608,640 | S | 1/2010 | Carreno | |
| D609,093 | S | 2/2010 | Wisniewski et al. | |
| D609,964 | S | 2/2010 | Lane | |
| D610,402 | S | 2/2010 | Carreno | |
| D610,454 | S | 2/2010 | Lohrman et al. | |
| D623,896 | S | 9/2010 | Wahl et al. | |
| D630,093 | S | 1/2011 | Bardet | |
| D634,628 | S | 3/2011 | Goto et al. | |
| D636,672 | S | 4/2011 | Lohrman et al. | |
| D652,256 | S | 1/2012 | Eyal | |
| D653,082 | S | 1/2012 | George | |
| D656,360 | S | 3/2012 | Miller et al. | |
| D663,209 | S | 7/2012 | Maas et al. | |
| 2003/0034323 | A1 | 2/2003 | Smith et al. | |
| 2004/0217139 | A1 | 11/2004 | Roth et al. | |
| 2005/0133475 | A1 | 6/2005 | Goto et al. | |
| 2006/0043052 | A1 | 3/2006 | Lin | |

FOREIGN PATENT DOCUMENTS

| | | |
|---|---|---|
| JP | 2000128218 | 5/2000 |
| JP | 2003205958 | 7/2003 |
| JP | 2004345742 | 12/2004 |
| JP | 2007320618 | 12/2007 |
| WO | 9624533 | 8/1996 |
| WO | 2011030830 A1 | 3/2011 |

OTHER PUBLICATIONS

Australian Examiner's First Report dated Dec. 19, 2012, 7 pgs.

Author unknown, Contigo—Autospout Addison Water Bottle—24 oz. print out of web page at http://www.gocontigo.com/autospout-addison-water-bottle.html, printed Jun. 20, 2012, 2 pages.

Author unknown, Zojirushi product—Stainless Steel Vacuum Bottle Model No. ST-KA12 print out of web page at http://www.zojirushi.com/productslstka, printed Jul. 26, 2011, one page.

* cited by examiner

DRINK BOTTLE AND LID WITH COVER FOR DRINK SPOUT

BACKGROUND OF THE INVENTION

1. Field of the Invention

The present invention relates generally to a drink bottle having a removable lid for a drink bottle, and more particularly to drink bottle in which the removable lid has an inner lid with a drink spout and an outer lid that selectively covers the drink spout.

2. Description of the Related Art

Personal beverage bottles are becoming ever more popular and have moved beyond the common beverage bottle packed with a school lunch or in a lunch box. Gyms are filled with members exercising, and many members bring their own beverage bottles for hydration. Hikers, bikers, walkers, commuters, tourists and many others carry beverage bottles as they go on their way. An increasingly common feature of the beverage bottles is a drink nozzle or spout that offers the ability to drink from the bottle without complete removal of the lid from the bottle. Another feature of some drink bottles is a cover for drink spout or nozzle to keep the spout or nozzle clean between drinking.

An example of a beverage bottle having a removable lid with a drink spout and a cover selectively securable over the drink spout is U.S. design Pat. D592,012 S. Another example is shown in U.S. design Pat. D609.964 S.

SUMMARY OF THE INVENTION

The present invention provides a beverage bottle with a removable lid wherein the lid has an inner lid with a drink spout and an outer lid or cover that pivots to selectively cover the drink spout. The outer lid may be locked to the inner lid when in the closed positioned. A push button on the inner lid can be operated to release the locked outer lid, permitting the outer lid to open so as to permit drinking from the drink spout. The inner and outer lids are connected to one another by a hinge that is selectively releasable to permit the outer lid to be removed from the inner lid. The outer lid can be readily reattached to the inner lid by reattaching the hinge elements to one another. The structures of the inner and outer lids are formed to promote release of the outer lid from the inner lid when the outer lid is subject to a release force while providing a reinforced mounting of the hinge elements that resist breakage.

The hinge that connects the inner lid and outer lid may be configured to block openings in the hinge structure to avoid pinching of fingers or other things which might otherwise occur.

The outer lid may include a bail handle by which the bottle can be carried. The bail handle is movable between a deployed position at which it extends from the outer lid and a stored or stowed position at which it fits into a recess in the outer lid. The bail handle is selectively releasable from the outer lid when subject to a release force. The structure of the bail handle and the outer lid is configured to promote release of the bail handle without breakage when subject to a release force. The bail handle is readily reattached to the outer lid.

The push button by which the outer lid is released from the locked position on the inner lid may be enclosed within a tunnel in the inner lid to shield elements of the push button mechanism.

As a result, a more durable beverage bottle is provided that resists breakage by permitting release of reattachable components.

DETAILED DESCRIPTION OF THE PREFERRED EMBODIMENTS

Figure 1:
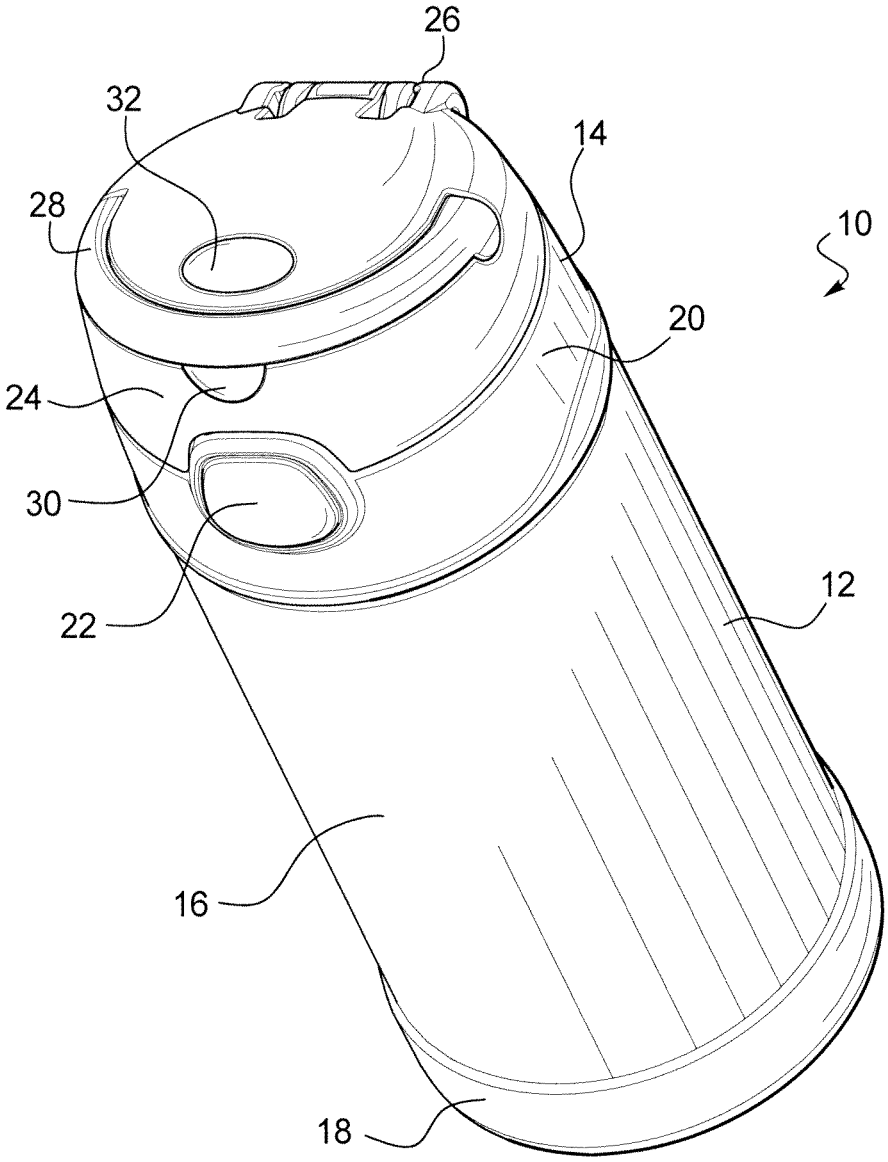
FIG. 1 is a top perspective view showing a drink bottle according to the principles of the present invention.

Referring first to FIG. 1, a beverage bottle 10 includes a bottle body 12 to which is attached a removable lid 14. The bottle body 12 may be of any suitable material, including metal, plastic, glass, rubber and combinations thereof and may be insulated or un-insulated. In the illustrated embodiment, the bottle body 12 is formed of an insulated stainless steel body part 16 on the bottom of which is fastened a plastic or rubber base 18. The bottle body 12 of a preferred embodiment is of a double-walled construction between which is an evacuated space, forming a so-called vacuum bottle. The lid of the present invention may be used on a rigid bottle, as illustrated, or on a flexible bottle. The flexible bottle permits the user to squeeze the bottle to force the beverage from bottle, while the rigid bottle requires the user to draw the liquid out of the bottle through suction or by pouring the liquid from the bottle.

Figure 6:
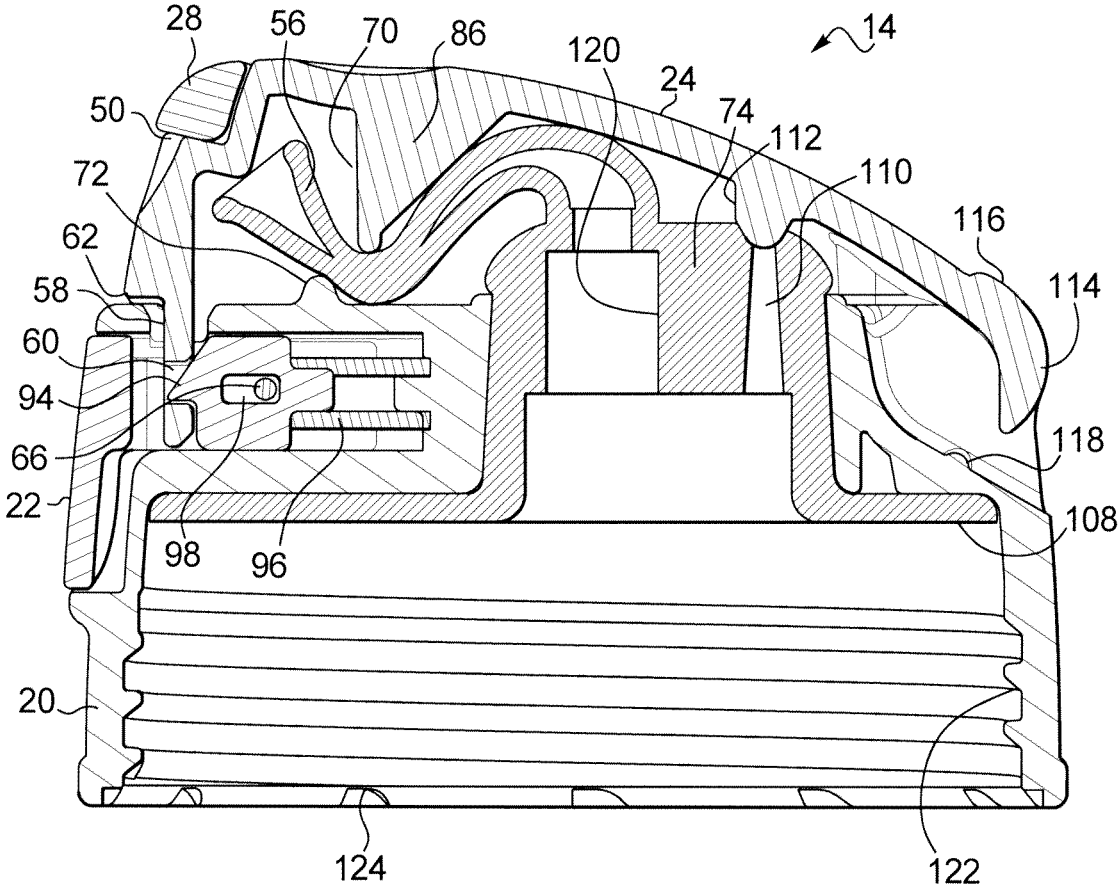
FIG. 6 is a cross-sectional view of the removable lid along the section line IV-IV of FIG. 9.

The removable lid 14 is secured to the mouth of the bottle 12 by a threaded connection in the illustrated embodiment, as will be apparent in FIG. 6. Threads are formed about the mouth of the bottle 12 and cooperating threads are formed within the lid 14 to that the lid 14 may be threadably attached to and detached from the bottle 12. The bottle 12 may be a narrow-mouth bottle or a wide-mouth bottle, a wide-mouth bottle is shown. Other fastening means to attach the lid 14 to the bottle 12 may be provided instead, such as a snap-on lid that fits onto a rim on the bottle, a bayonet attachment, or other lid attachment structure.

The removable lid 14 has an inner lid 20, a push button 22, an outer lid or cover 24 and a hinge 26 that connects the inner lid 20 to the outer lid 24. A bail handle 28 is provided on the outer lid 24. A thumb notch 30 is provided on the outer lid 24 to enable the user to engage the bail handle 28 so as to move the bail 28 from a stowed condition, as shown, to a deployed condition. A depression 32 is formed on the top of the outer lid 24 on which the user may press to cause the outer lid 24 to engage the inner lid 20 in a locked condition.

Figure 2:
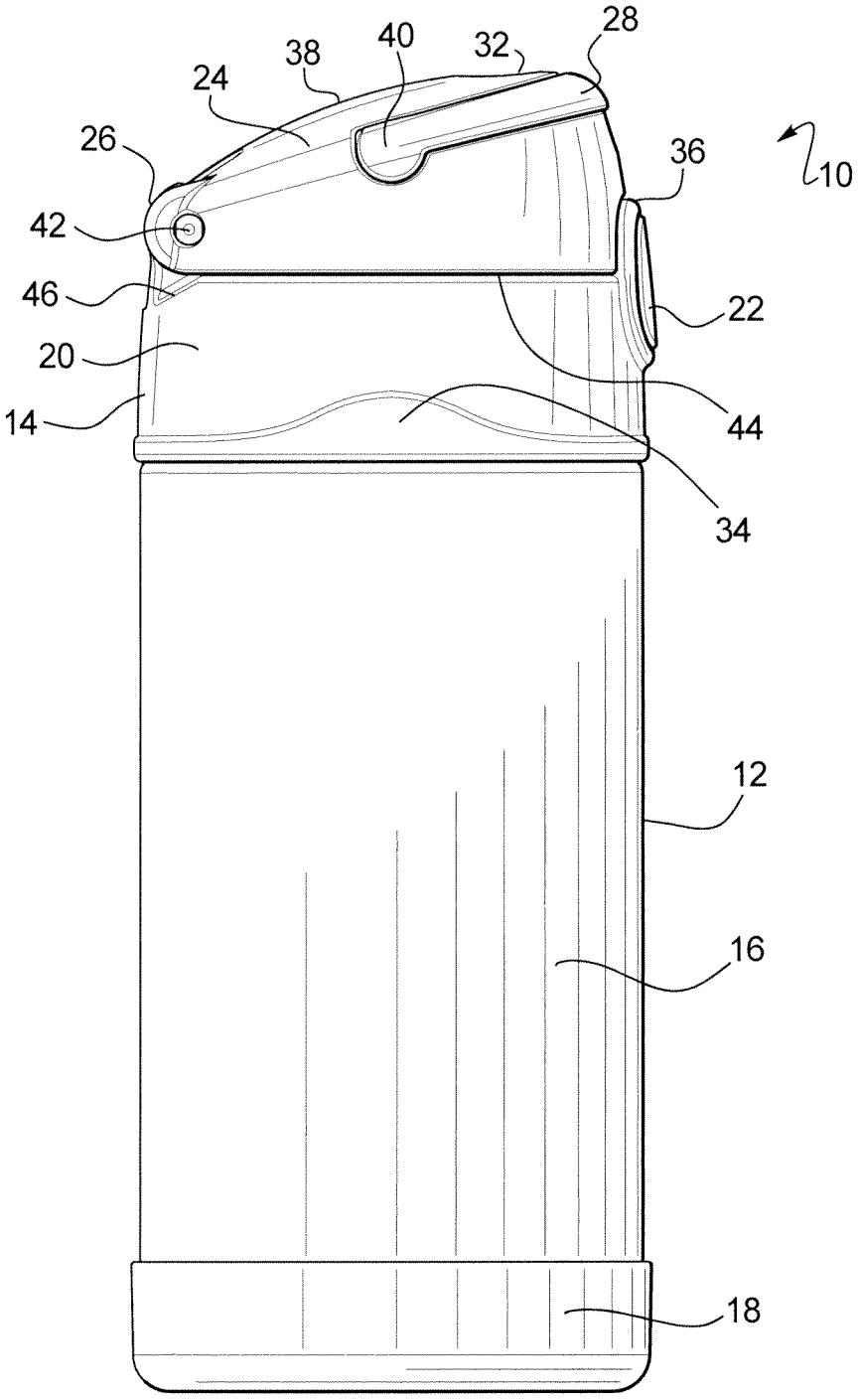
FIG. 2 is a side elevational view of the present drink bottle.

In FIG. 2, the bottle 10 has the base 18 that provides protection for the bottom of the bottle as well as providing a relatively wide surface on which the bottle is rested when standing. The base is of a plastic material, such as polypropylene, although other materials are of course possible. The bottle body 16 has a smooth surface which may be provided with patterns, such as by printing, painting, embossing or otherwise. The inner lid 20 in the illustrated embodiment includes a decorative embossing 34. Other patterns or shapes may be provided on the inner lid 20 instead. The inner lid 20 has a raised rim 36 surrounding the button 22 that projects slightly from the front of the lid 14. The upper lid 24 includes a cut-out that accommodates the raised rim 36. The upper lid 24 also has a sloping, domed top surface 38, along the edge of which is the stowed bail handle 28. The ends 40 of the bail handle 28 are semi-circular and fit into semi-circular recesses in the outer lid 24. At the hinge 26 is seen an opening 42 within which is seen a hinge pin. The lower edge 44 of the outer lid 24 extends in a flat plane generally transverse to the axis of the bottle 10. The inner lid 20 includes a correspondingly shaped upper edge except that a bevel 46 is provided in the inner lid 20 adjacent the hinge 26.

Figure 3:
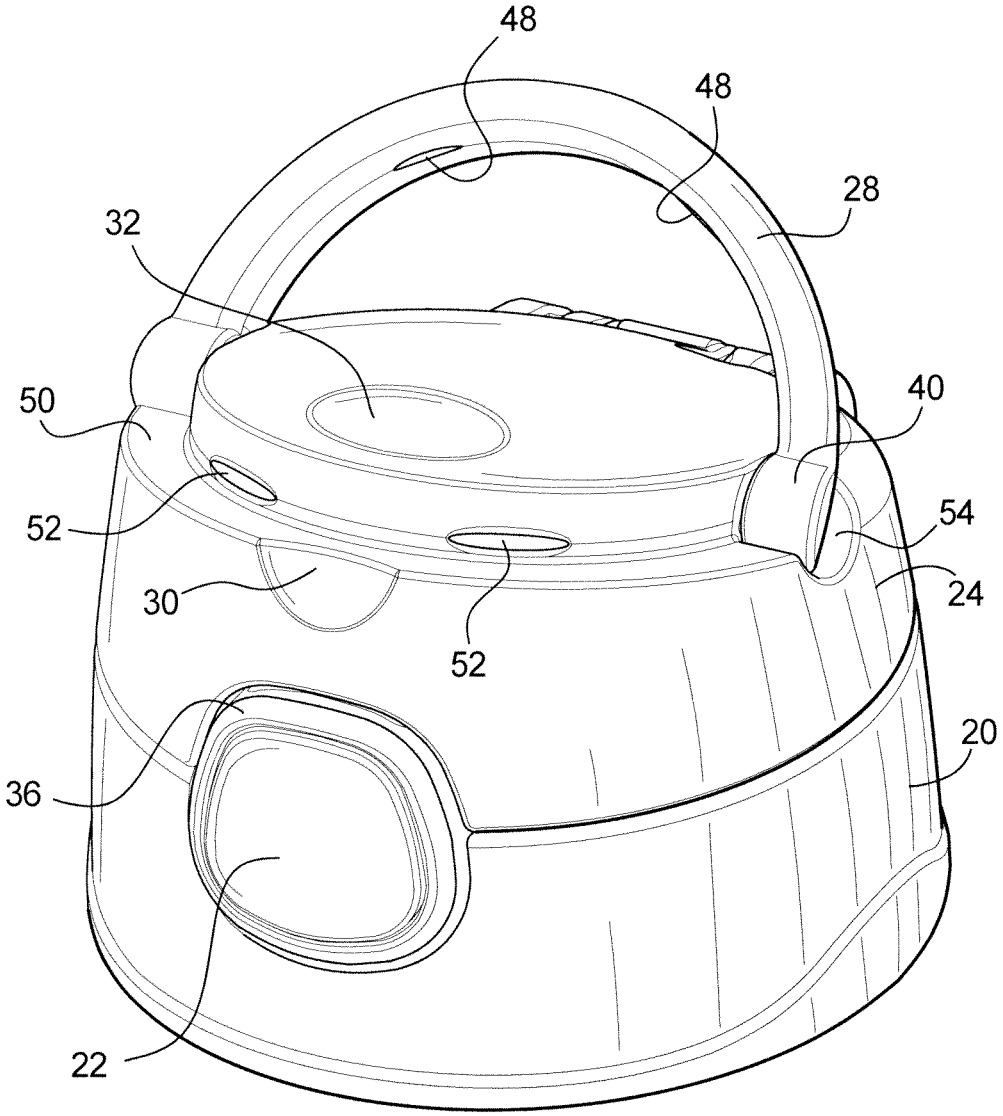
FIG. 3 is a front perspective view of the removable lid of FIGS. 1 and 2 showing an outer lid or cover in a closed position and a bail handle in a deployed position.

Turning to FIG. 3, a user has moved the bail handle 28 to the deployed position so that it extends from the outer lid 24 and forms a carrying handle. The bottle 10 may be carried by the bail handle 28 or hung by the bail handle 28, such as on a hook for a store display. The inner surface of the bail handle 28 includes two retainer projections 48 that extend inwardly. A recess channel 50 is formed on the outer lid 24 for receiving the bail handle 28 when in the stored position, as shown in FIG. 1. Within the recess channel 50 is provided two retainer indentations 52 into which the projections 48 fit when the bail handle 28 is in the stored position. The bail handle 28 snaps into the stowed position in the recess channel 50 and is held in place by the retainer projections 48 and retainer indentations 52 until a user inserts a finger into the thumb notch 30 and forces the bail handle 29 out of the snap engagement stowed position. Other numbers or arrangements of projections, indentations or other structures for retaining the bail handle in position are contemplated as well.

The bail handle 28 includes the semi-circular ends 40 that rotate in the semi-circular recesses 54 at the ends of the recess channel 50 in the outer lid 24 when the bail handle 28 is moved between the stowed and deployed positions.

Figure 4:
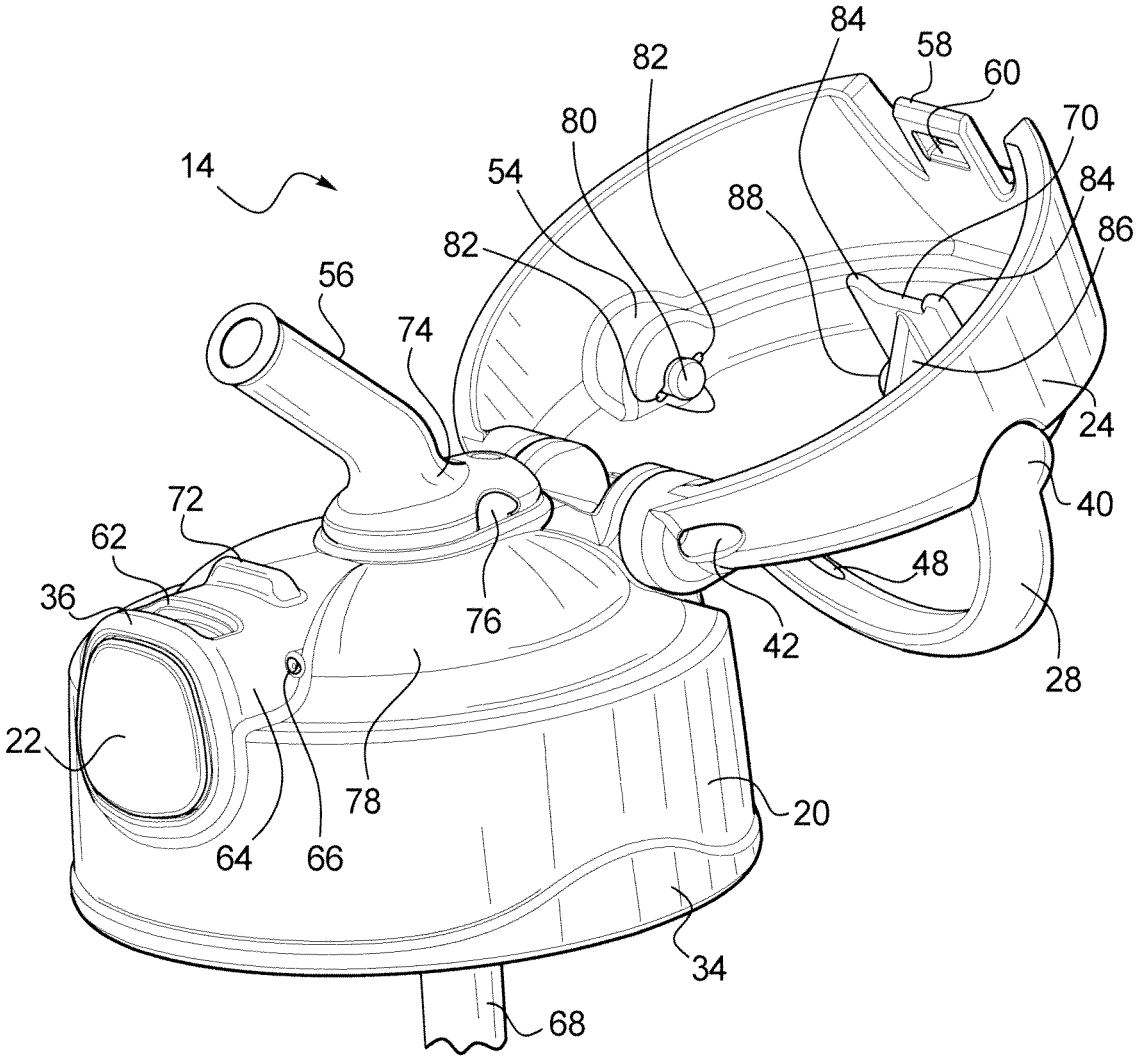
FIG. 4 is a perspective view of the removable lid showing the outer lid or cover in an open position.

FIG. 4 shows the outer lid or cover 24 in the open position, revealing a drink spout 56. The outer lid 24 is movable to the open position after a user releases the locking mechanism by pressing the release button 22. The locking mechanism includes a tab 58 on the outer lid 24 that has an opening 60 extending through the tab 58. The tab 58 is at the cut-out in the outer lid 24 that accommodates the projecting rim 36 when the outer lid 24 is closed. As the outer lid 24 is pivoted to the closed position, the tab 58 fits into a slot 62 on the inner lid 20. Within the slot 62 is a catch mechanism that engages the opening 60 in the tab 58 to hold the outer lid 24 in the closed position on the inner lid 20. The slot 62 is formed in a tunnel structure 64 formed on the inner lid 20. The tunnel 64 encloses the working parts of the locking mechanism that is operated by the button 22 to protect it from damage and to keep unwanted matter out. For example, spilled beverages are kept from the locking mechanism by the tunnel 64. The raised rim 36 that extends from the outer lid 24 around the button 22 when the outer lid 24 is closed is at the end of the tunnel 64. An end of a pin 66 that holds the locking mechanism in the tunnel 64 is visible at the surface of the tunnel 64. The pin 66 extends into and through the tunnel 64.

The drink spout 56 is shown extending upwardly at a convenient angle for drinking from the drink bottle. The drink spout 56 is connected in fluid communication to a straw 68 that extends from the underside of the inner lid 20 and into the drink bottle 12. The user may drink from the bottle while keeping the bottle upright by sipping from the spout 56. The straw 68 preferably extends to the bottom of the bottle 16 and may extend coaxially within the bottle or extend at an angle to a lower corner of the bottle, for example.

The spout 56 is formed of a pliable material, such as silicon rubber that flexes and bends readily. When the outer lid 24 is moved to the closed position, a bending flange 70 extending from the inner surface of the outer lid presses on the spout 56 and bends it down from the upwardly angled position shown in FIG. 4. The downwardly flexed spout 56 presses against a counter ridge 72 on the inner lid 20. The counter ridge 72 is on the tunnel 64 in the illustrated embodiment. The combined effects of the bending flange 70 and the counter ridge 72 is to pinch the spout 56 so as to close the spout and prevent leakage of fluid from the drink bottle 10.

The spout 56 extends from a spout base or pedestal 74 that is mounted in an opening in the inner lid 20. The spout base 74 is shaped in an extended shape in a direction perpendicular to the axis of the fluid passageway so the spout 56 is prevented from being rotated in the inner lid 20. The drink spout 56 is assured of facing toward the button 22. A notch 76 is formed on each side of the spout base 74. The notches 74 permit the spout base 74 to deform for mounting in the opening of the inner lid 20.

The inner lid 20 has a dome shaped upper surface 78. The spout base 74 is mounted on the dome 78, thereby positioning the spout 56 higher on the bottle 10 for more convenient drinking. The dome 78 receives the tunnel structure 64 in which the release button 22 is mounted, thereby strengthening the tunnel 64. The dome 78 also strengthens the hinge structure, as will be described hereinafter.

The bail handle 28 is connected to the outer lid 24 by pins 80 that extend from the bail handle 28 through openings in the outer lid 24 at the recess 54. The openings in the outer lid 24 that receive the pins 80 include slots 82.

The bending flange 70 on the inside of the outer lid 24 has projections 84 on either side to keep the drink spout 56 centered on the flange 70 when closing the outer lid 24. The bending flange 70 is supported by a gusset 86. In the view of FIG. 4 can be seen an edge of a projection 88 on the inside of the outer lid 24. The bending flange 70 and gusset 86 are mounted on the projection 88. The projection 88 is the inside surface of the depression 32 on the outside of the outer lid 24. By this arrangement, pressure exerted by the user at the finger-shaped depression 32 is transmitted directly through the bending flange 70 and gusset 86 to flex the drink spout 56 and bring the outer lid 24 to the closed and locked position on the inner lid 20.

Figure 5:
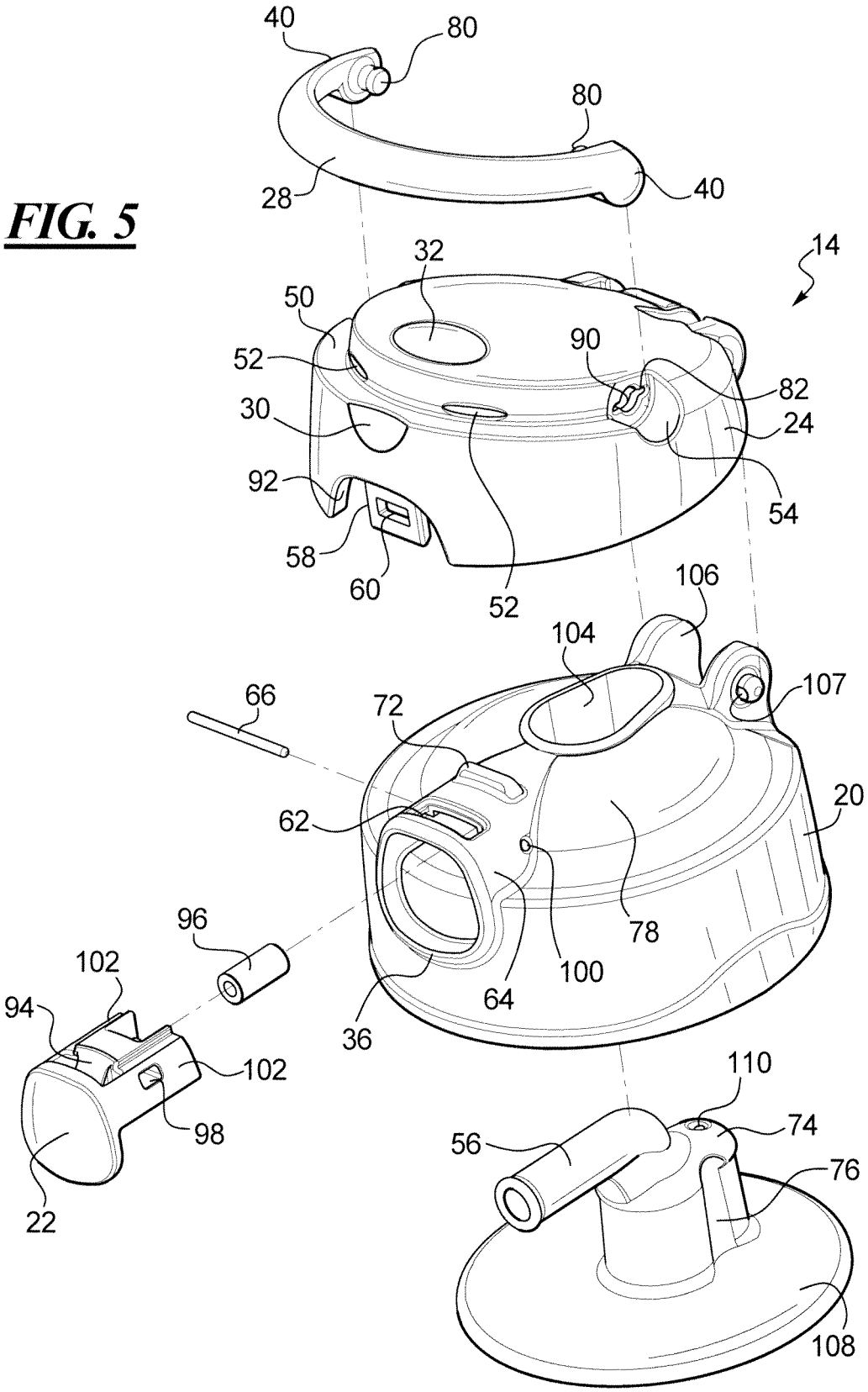
FIG. 5 is an exploded view of the removable lid showing an inner lid, an outer lid, bail handle, release button and drink spout.

In FIG. 5, the removable lid 14 is shown in exploded view. From the top, the bail handle 28 has the pins 80 extending from the semi-circular ends 40. Next, the outer lid 24 has the finger depression 32 on the dome-shaped top. The recess channel 50 extends to the semi-circular recesses 54 that include holes 90 into which the pins 80 fit. The slots 82 extend from the holes 90 to permit the material surrounding the holes to flex so that the pins 80 can be inserted into and pulled from the holes 90. The tab 58 with the opening 60 extends from the outer lid 24 at the cut-out 92 that fits over the tunnel structure 64. The indentations 52 in the bail recess channel 50 by which the bail 28 is secured in the stowed position and the notch 30 by which the bail 28 is urged from its stowed position are also seen.

In the inner lid 20 is formed the tunnel 64 within which is mounted the button 22. The button 22 has a catch nose 94 that engages into the opening 60 in the tab 58 of the outer lid 24 when the tab 58 is inserted through the slot 62 in the tunnel 64. The release button 22 is biased to a position engaging the tab 58 by a spring 96 that is mounted within the tunnel 64 between structures within the inner lid 20 and the button 22. The spring 96 may be formed or any of several different materials and may be formed as a coil spring or otherwise. In the illustrated embodiment, the spring 96 is a tube of compressible rubber, such as silicone rubber, that compresses when the button 22 is pressed and that returns the button 22 to a locking position when the button 22 is released. Pressing on the button 22 to compress the spring 96 moves the catch nose 94 in the button 22 out of engagement with the opening 60 in the tab 58 of the outer lid 24, permitting the outer lid 24 to open.

The release button 22 is held in the tunnel 64 by the pin 66 that passes through an opening 98 in the button 22 and through openings 100 in the tunnel 64 of the inner lid 20. Sliding arms 102 are provided on the release button 22 to facilitate sliding movement of the button 22 within the tunnel structure of the inner lid 20.

The inner lid 20 has an elongated opening 104 in which is mounted the drink spout 56. Two hinge uprights 106 are on the rear of the inner lid 20 to which cooperating hinge parts on the outer lid 24 are mounted.

The drink spout 56 is formed of a pliable, food safe material, such as silicone rubber so that it may be bent and flexed to a variety of shapes. The drink spout 56 extends from the spout base or pedestal 74 which is shaped to fit snuggly in the elongated opening 104 of the inner lid 20. The notches 76 provide a flexing location by which the pedestal is flexed during insertion into the inner lid 20. The pedestal 74 extends from a gasket disk 108 that is mounted within the inner lid 20 and which forms a fluid-tight seal against the mouth of the bottle 16 when the removable lid 14 is fastened into place. The gasket disk 108 is of a size to accommodate the mouth of the bottle 16, a gasket disk 108 for a wide mouth bottle is shown. It is also foreseen that the gasket may be separate from the drink spout 56 as well. The spout base or pedestal 74 includes a vent hole 110 by which air enters the bottle 16 during drinking of fluid from the drink spout 56 by a user. The straw 68, shown in FIG. 4, is fastened into the spout base or pedestal 74 so as to extend into the interior of the bottle 16.

The spout pedestal 74 is insertable into the opening 104 in the inner lid 20 during assembly of the present removable lid 14. The snug fit of the pedestal 74 in the opening 104, and possibly the addition of a flange extending from the pedestal 74 above the top of the opening, holds the drink spout 56 in position in the inner lid 20. The notches 76 on the sides of the pedestal 74 permit flexing of the pedestal 74 as it is inserted. The drink spout 56 can be removed from the inner lid 20 by forcing the pedestal 74 out of the inner lid 20. The compressible pedestal 74, in part due to the notches 76, facilitates removal of the drink spout 56. This permits the spout 56 to be cleaned and possibly to be replaced if needed. The drink spout 56 is reattached to the inner lid 20 by inserting the pedestal 74 into the opening 104 and forcing it into position. The straw 68 is also selectively removable for cleaning or replacement as needed.

The bail handle 28, outer lid 24, and inner lid 20 are of polypropylene in one embodiment. The release button 22 may be of polypropylene or another material. As noted above, the drink spout 56 and spring 96 are of silicone rubber. Other materials are of course possible and are encompassed within the scope of the present invention.

FIG. 6 provides an interior view of the removable lid 14. The bail handle 28 is shown in the stowed position in the recess channel 50. The outer lid 24 has the tab 58 inserted through the slot 62 so that the catch nose 94 engages the opening 60. This locks the outer lid 24 into the closed position on the inner lid 20. The spring 96 that is compressed when the release button 22 is pressed is visible in its installed position. The pin 66 that extends through the opening 98 in the button 22. The button 22 is constructed to permit translation or sliding movement within the inner lid 20 to move been the locked and unlocked positions.

The drink spout 56 is in the crimped position as a result of being pressed by the bending flange 70 and against the counter ridge 72. This crimping closes the fluid flow passageway within the drink spout 56 to guard against leakage of beverages contained within the bottle 10. The resilient nature of the drink spout 56 and the material of which it is formed biases the outer lid 24 toward the open position as a result of the bending flange 70 pressing on the spout material. As a result, the outer lid 24 pops open when the release button 22 is pressed.

The vent hole 110 in the pedestal or spout base 74 is closed by a vent pin 112 that extends from the interior of the outer lid 24. Closing of the vent hole 110 helps prevent leaking of the liquid from the drink bottle, for example when the bottle is stored on its side such as when stuffed into a school locker or gym bag. When the outer lid 24 is opened, the vent pin 112 moves clear of the vent hole 110, permitting air into the interior of the bottle 10 when a user drinks from the spout 56. Venting of the bottle during drinking is necessary for rigid bottles due to the low pressure that could otherwise develop as liquid is drawn from the bottle. If the present lid is to be used on a flexible squeeze bottle in which the user squeezes the bottle to force the beverage from the drink spout, the vent hole and the vent closing pin are not necessary and need not be included. If the lid will be used exclusively on a squeeze bottle, the vent hole should be avoided to prevent exit of the liquid via the vent hole during squeezing.

The hinge parts of the outer lid 24 include a center cover 114 that curves to cover a space between the hinge uprights 106 of the inner lid 20. The center cover includes a cam surface 116 that engages a cam ridge 118 on the inner lid 20 when the outer lid 24 is pivoted to the fully open position. The engagement of the cam surface 116 and cam ridge 118 retains the outer lid 24 in the open position to keep the lid out of the way when a user is drinking from the spout 56. Only a little force is required to move the cam surface 116 out of retaining engagement with the cam ridge 118 so that the outer lid 24 can be pivoted from the fully open position, such as to move the lid to the closed position.

The gasket disk 108 is positioned on the top interior surface of the inner lid 20 to provide a fluid tight enclosure for any beverages within the bottle 10. The spout base or pedestal 74 defines a passageway for the vent 110 into the interior of the bottle 10 as well as a fluid passageway through the spout 56 to a straw mounting bore 120 into which the straw 68 (not shown) is mounted. An alternative to the straw mounting bore 120 within the pedestal 74 is to provide a sleeve that extends below the pedestal 74 into the interior of the bottle as a continuation of the fluid passageway within the drink spout 56. The sleeve receives the end of a straw that reaches to the bottom of the interior of the bottle. The preferred sleeve is a pliable sleeve of the same material as the gasket and spout that holds the straw in a fluid-tight engagement. The interior of the inner lid 20 is threaded at 122 so that it can be threaded on to threads on the bottle 16. Notches 124 are provided in the lower edge of the inner lid 20 for removal of the lid 20 from the mold in which the lid is formed.

Figure 7:
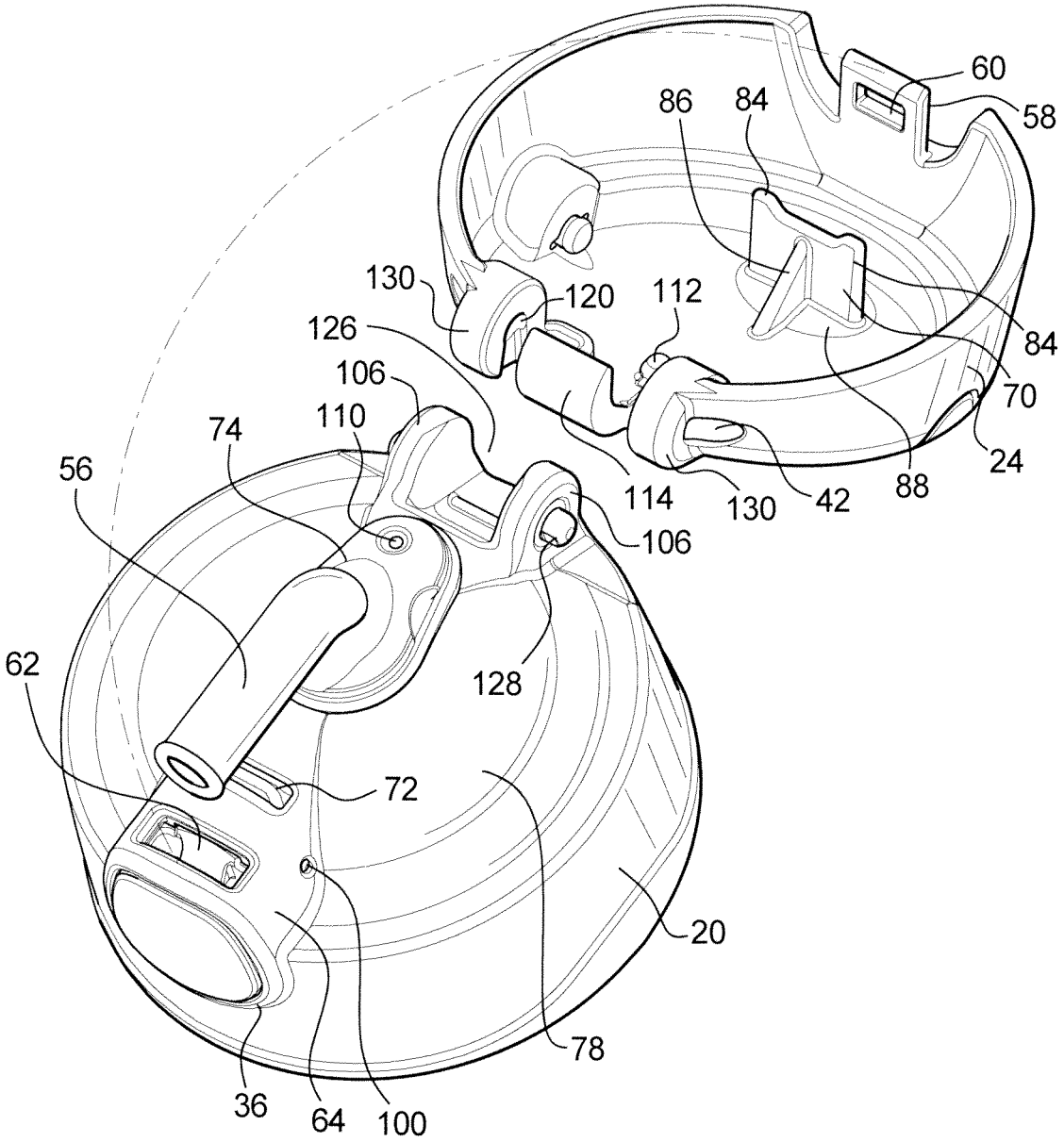
FIG. 7 is a top perspective view showing the outer lid or cover removed from the inner lid.

FIG. 7 shows the outer lid 24 removed from the inner lid 20. The outer lid 24 has been pivoted to the open position. With the outer lid 24 in the fully open position, in which the outer lid 24 is generally inverted relative to the closed position of the outer lid 24, the cam surface 116 and a cam ridge 118 cooperate to hold the outer lid 24 open. Further pivoting force on the outer lid 24 results in the hinge elements disengaging from one another to that the outer lid 24 is free of the inner lid 20, as shown in FIG. 7. This movement may be referred to as pivoting the outer lid beyond the fully opened position to a release position. The disengagement of the lids 20 and 24 from one another occurs without breaking or otherwise damaging or misshaping the parts. It is also possible that the outer lid 24 may become disengaged from the inner lid 20 other than by being pivoted beyond the fully opened position, for example, if the bottle is inadvertently dropped or otherwise subject to a force.

The outer lid 24 is easily reattached to the inner lid 20 by positioning the lids generally as shown in FIG. 7, then positioning the hinge parts of the outer lid 24 onto the top of the hinge parts of the inner lid 20 and pressing the hinge parts together. The hinge parts reassemble with a snap and the lids 20 and 24 are once again pivotally joined.

The hinge 26 is formed by the hinge uprights 106 on the inner lid 20 that are spaced from one another to define a center gap 126. The outward facing surfaces of the hinge uprights 106 are provided with hinge pins 128. The outer lid 24 has a pair of hinge bearings 130 that are spaced from one another by a distance to span the outside of the hinge uprights 106. The opening 42 is provided through each of the hinge bearings 130 into which the pins 128 fit when the hinge parts are connected to one another. The center cover 114 extends between the hinge bearings 130.

The bending flange 70 with the projections 84 and the support gusset 86 mounted on the projection 88 is seen within the outer lid 24 as is the vent pin 112.

Figure 8:
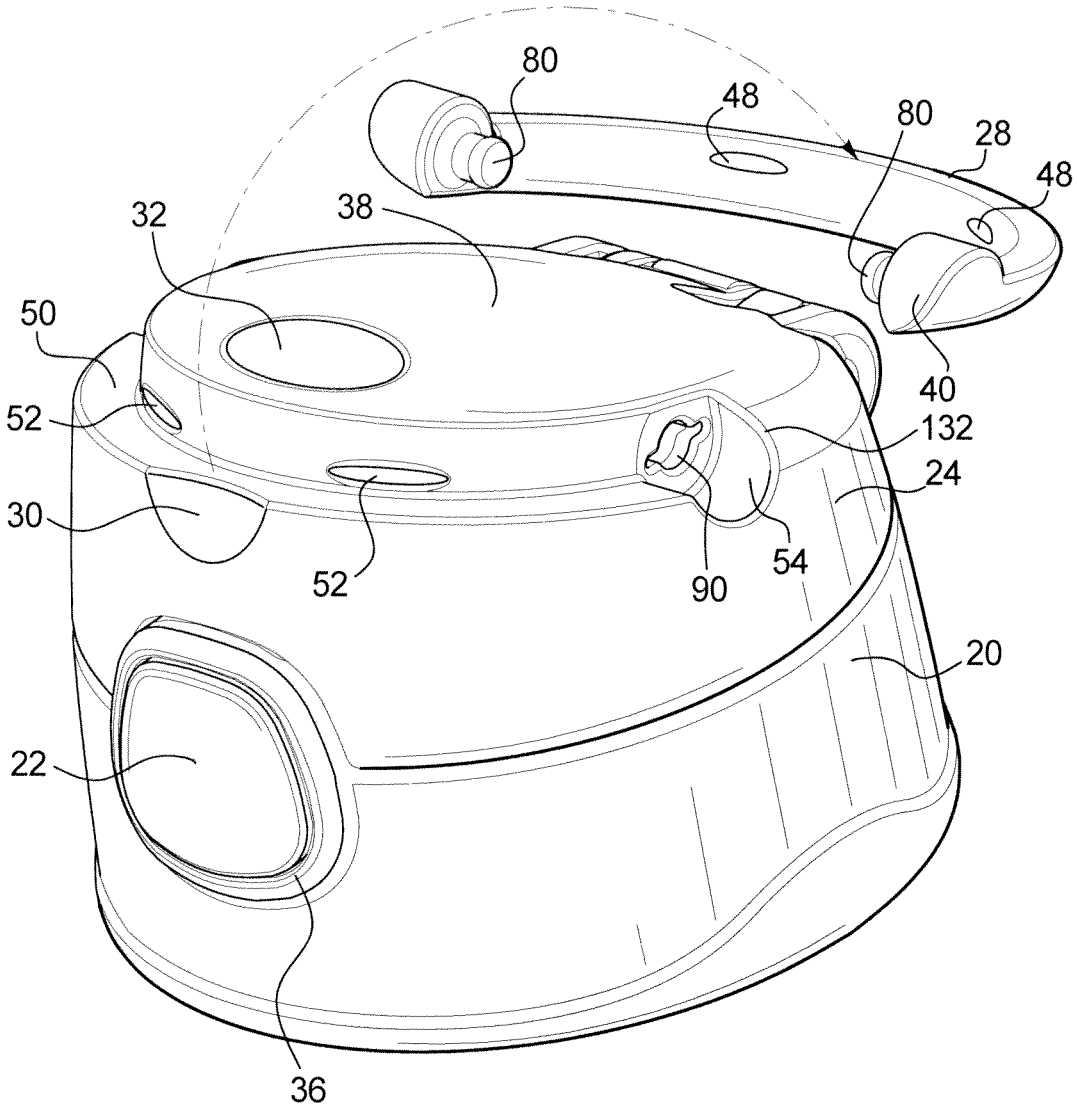
FIG. 8 is a front perspective view of the removable lid showing the bail handle removed from the outer lid.

In FIG. 8, the bail handle 28 has been pivoted to the deployed position as shown for example in FIG. 3 and then a further pivoting force exerted on the bail handle 28. As a result of the further pivoting force, the bail handle 28 pops loose of the outer lid 24 without damage to either the bail 28 or the lid 24. Reattachment of the bail handle 28 to the outer lid 24 is accomplished by positioning the pins 80 over the holes 90 in the outer lid 24 and pressing inward to snap the pins 80 back into place.

The bail handle 28 and outer lid 24 are configured to release the bail from the lid when pressed beyond the fully deployed position. In particular, the semi-circular recess 54 in the outer lid 24 has a back edge 132 that slopes downward and outward relative to the pivot axis of the bail handle 28. The outward sloping back edge 132 is a continuation of the dome-shaped top 38 of the outer lid. When the bail handle 28 is in the fully deployed position, the handle bears against the back edge 132. Further pressure on the bail handle 28 in the pivot direction results in an outward force on the pivot pins 80 pulling in opposite directions as a top surface of the bail handle 28 slides on the outwardly angled back edges 132. This force pulls the pins 80 outward from the holes 90 rather than shearing the pins off. The bail 28 is disassembled from the lid without breakage and can readily be reattached.

Figure 9:
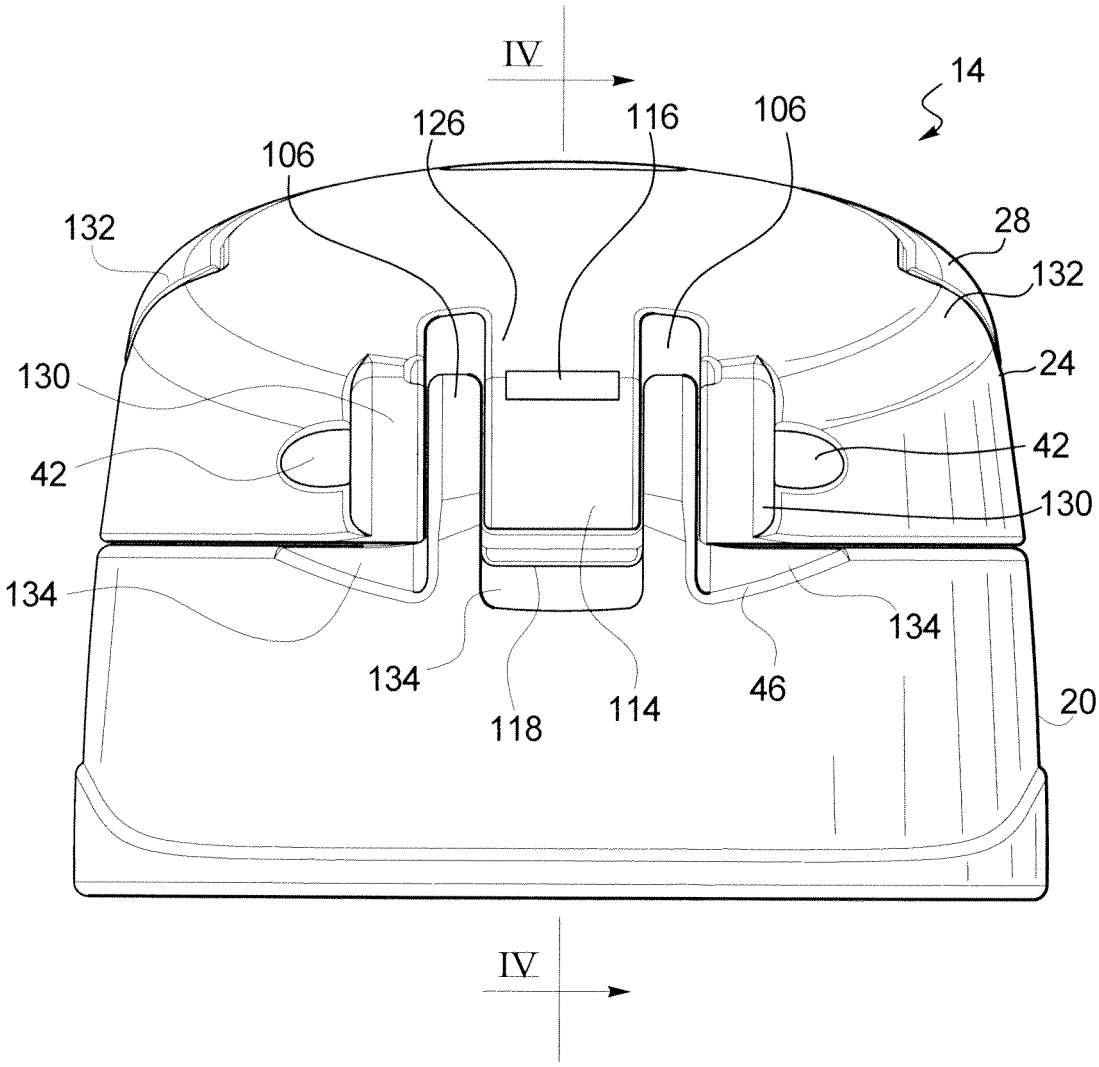
FIG. 9 is rear elevational view of the removable lid.

In FIG. 9, the rear of the lid 14 in the closed position includes the uprights 106 on the inner lid 20 that define the center gap 126 therebetween. The center cover 114 fits between the uprights 106 to fill the center gap 126. The center cover 114 carries the cam 116 that engages the cam ridge 118 on the inner lid 20 which holds the outer lid 24 in position when in the open position. The center cover 114 also covers the center gap 126 to prevent fingers or other things from being inserted into the center gap 126 when the lid 24 is closed and thereby getting pinched when the lid 24 is being opened.

The hinge bearings 130 are disposed on opposite sides of the uprights 106 engage the hinge pins 128 to permit pivoting movement of the lids relative to one another. The bevel 46 on the inner lid 20 at the hinge includes three beveled surfaces 134 separated by the uprights 106. The beveled surfaces 134 are positioned so that movement of the outer lid 24 beyond the fully open position causes the outer lid 24 to contact the beveled surfaces 128, which exerts a disconnecting force on the hinge. In particular, pushing the outer lid 24 past its fully open position causes a lifting motion on the bearings 130 relative to the uprights 106 so that the bearings 130 are pulled off of the hinge pins 128.

The downward and outwardly sloping back edges 132 of the bail recess channel 50 which cause the bail pivot pins of the bail handle 28 to be pulled outwardly in opposite directions so that they disengage from the holes 90 in the outer lid 24 are apparent in the view of FIG. 9. When the bail handle 28 is pressed with sufficient force, which may also be termed a disengaging force, against the outwardly sloping back edges 132, the bail ends slide outwardly along the back edges 132, resulting in the bail pins 80 being drawn out of the holes. The bail pins 80 each include a widened cap at the free end to hold the pins in the holes 90 and thereby prevent the bail 28 from being disengaged too easily.

An objective is to permit the parts to disengage from one another when subject to a force that might otherwise break the parts, but not to have the parts come apart so easily that the user is constantly faced with reassembling the beverage bottle. A typical user might be able to use the bottle without the parts every becoming disassembled. However, if the beverage bottle is dropped of subject to more than a normal use force, the parts simply pop off without breakage.

Figure 10:
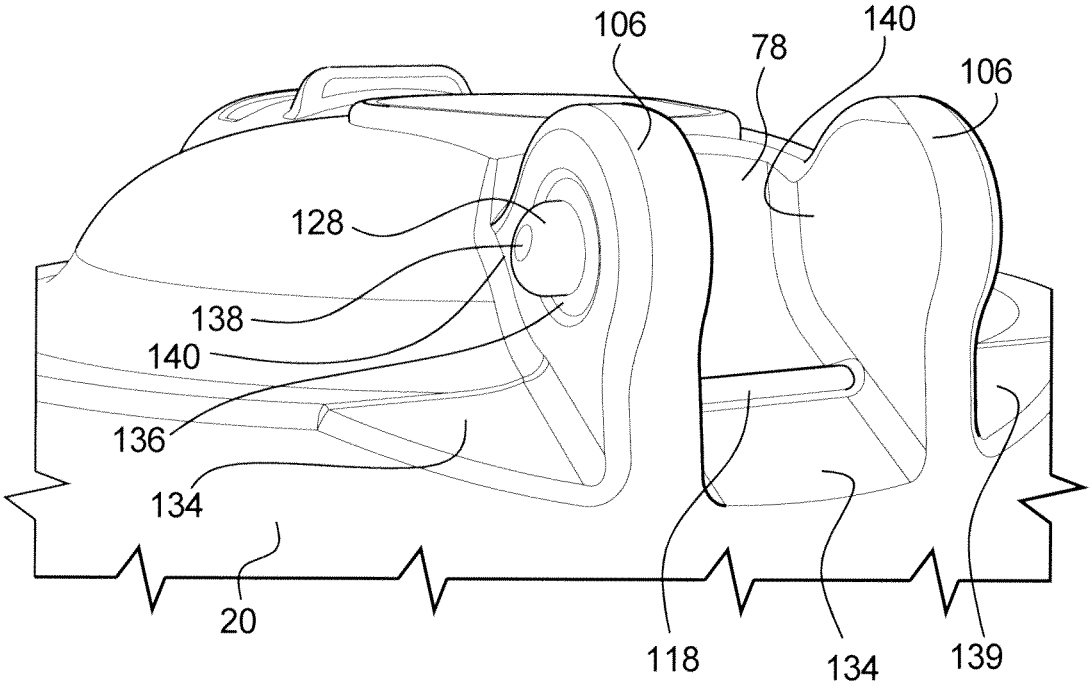
FIG. 10 is an enlarged perspective view of the hinge uprights of the inner lid.

Turning to FIG. 10, the hinge uprights 106 on the inner lid 20 include the hinge pins 128 extending outwardly from the uprights 106. The hinge pins 128 are encircled by a recess 136. The recess 136 may provide flexibility to the hinge pins 128 to permit flexing without breakage. The hinge pins 128 include rounded edges and include an angled end surface 138. The angled end 138 results in the pin 128 having a shorter bearing surface in a direction facing away from the inner lid 20 and a longer bearing surface in a direction facing toward the inner lid 20. The effect is to require less force for the outer lid 24 to be re-attached to the inner lid 20 than the amount of force for the outer lid 24 to be disconnected from the inner lid 20. As such, even though the outer lid 24 is removable by pressing beyond the fully open position, re-attachment of the outer lid 24 should be easily accomplished by the user to return the removable lid to its fully operating condition.

Other shapes of hinge pins are encompassed within the invention, including hinge pins that include an end surface transverse to the shaft of the pin. It is foreseen to provide the hinge pins with flats on one or more sides that narrow the pins in a removal and reattachment direction. An example of flats 107 on the hinge pins is shown in FIG. 5. The flats 107 are on opposite sides of each hinge pin and the flats 107 are oriented to facilitate removal and reattachment of the outer lid in one direction but to resist removal of the outer lid in other directions. The hinge pins more easily slide along release channels in the hinge bearings in the preferred removal and reattachment direction.

The uprights 106 have a base connected to the inner lid 20 that extends not only in a direction perpendicular to the top surface of the inner lid 20 but also has an extended base portion 140 connected to the dome shaped upper surface 78. The extended base portion 140 provides a broader base for the uprights so that the uprights are reinforced by the dome 78. Additional resistance to breakage is provided to that the lid becomes disassembled without breakage. The beveled surface portions 134 are seen as well as the cam ridge 118.

Figure 11:
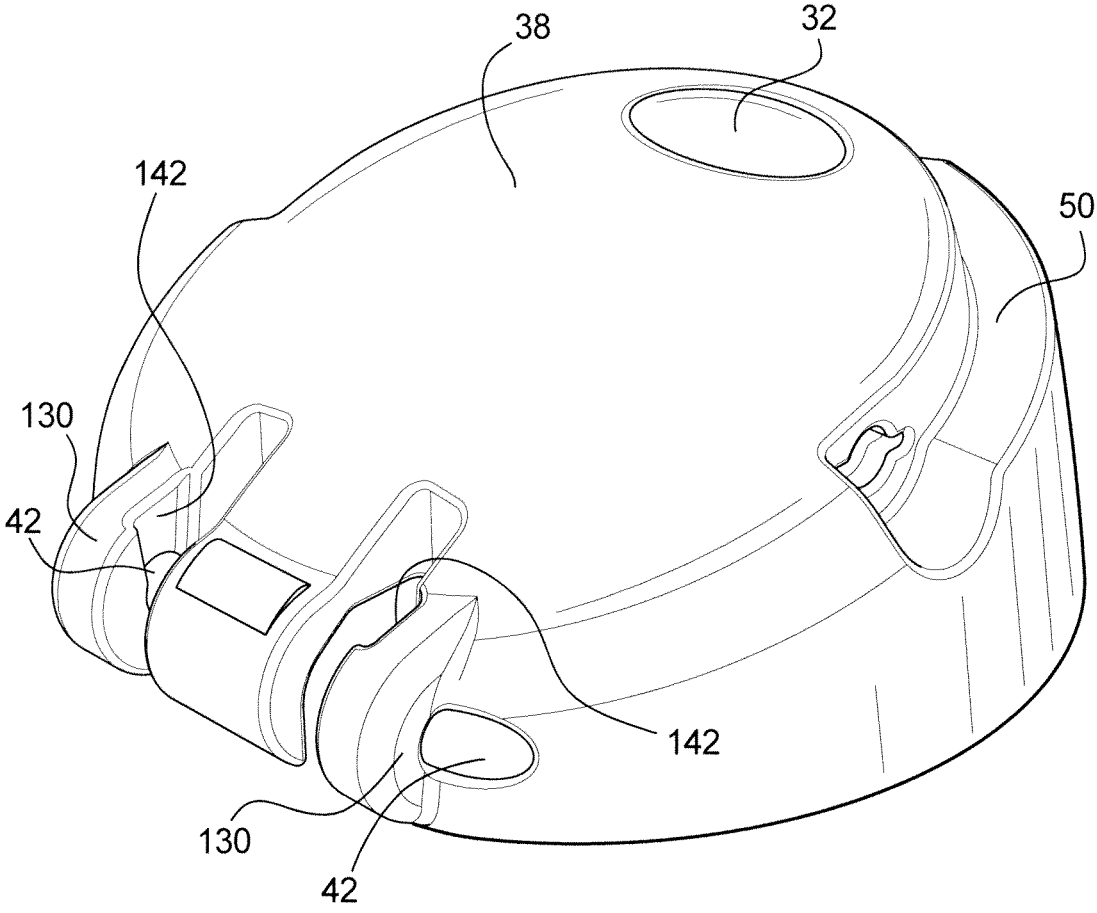
FIG. 11 is a top rear perspective view of the outer lid or cover.

Turning to FIG. 11, the outer lid 24 is seen from the top. The dome shaped top surface 38 that includes the depression 32, the bail recess 50 and the hinge bearings 130 is seen. The hinge bearings 130 include channels 142 that lead from the top surface of the lid 24 to the opening 42 into which the hinge pins 128 fit. The channels 142 provide a pathway for the hinge pins 128 to pass through when the outer lid 24 is removed from the inner lid 20 by pressing the outer lid 24 against the beveled surface portions 134 of the inner lid 20. As important is that the channels 142 provide a pathway for the hinge pins 128 to follow when the outer lid 24 is reassembled on the inner lid 20. As noted above, the outer lid 24 is positioned in an inverted position relative to the inner lid 20, the hinge elements are positioned together, and then a pressing force is applied to cause the hinge pins 128 to slide along the channels 142 and into place in the openings 42.

Thus, there has been shown and described a drink bottle having a removable lid that has a drinking spout and a lockable cover or outer lid over the drinking spout. The cover or outer lid and bail handle can become disassembled from the drink bottle without breakage. Both the cover or outer lid and the bail handle are easily reassembled on the drink bottle. The locking mechanism is enclosed within a tunnel structure to cover the moving parts. A raised dome structure on the inner lid extends to the tunnel structure as well as provides a beveled base for the hinge elements that connect the inner and outer lids.

Although other modifications and changes may be suggested by those skilled in the art, it is the intention of the inventor to embody within the patent warranted hereon all changes and modifications as reasonably and properly come within the scope of his contribution to the art.

I claim:

1. A drink bottle and lid, comprising:

a bottle having a mouth with a lid engaging structure;

a removable lid having a cooperating engaging structure for selective engagement with the lid engaging structure of said bottle;

said removable lid including an inner lid and an outer lid, said inner lid including said cooperating engaging structure, said inner lid defining a button tunnel and a spout opening, said button tunnel including an enclosing structure defining an enclosed channel to slidably receive a sliding element, said inner lid including a first hinge portion;

said outer lid including a second hinge portion for pivoting engagement with said first hinge portion to form a hinge so that said outer lid is pivotable relative to said inner lid between an open position and a closed position;

a button mounted within said button tunnel of said inner lid so as to be movable between a lock position and an unlock position, said button including a sliding arm slidably mounted within said channel within said enclosing structure of said inner lid, said sliding arm being enclosed within said enclosing structure to prevent contact with said sliding arm by a user, said sliding arm undergoing translational movement within said enclosed channel during movement of said button between said lock position and said unlock position;

a locking tab extending from said outer lid, said locking tab engaging said button when said outer lid is in said closed position and said button is in said lock position, said locking tab being disengaged from said button when said button is moved to said unlock position;

a drink spout mounted in said spout opening of said inner lid, said drink spout extending from said inner lid at a position to permit a user to drink fluid contained within the bottle from the drinking tube when said outer lid is in the open position, said outer lid covering said drink spout when said outer lid is in said closed position; and a bail handle mounted on said outer lid and pivotable between a stowed position and a deployed position.

2. A drink bottle and lid as claimed in claim 1, wherein said sliding arm of said button is a first sliding arm and further comprising a second sliding arm of said button, said first and second sliding arms being slidably received within corresponding enclosed sliding channels within said enclosing structure, said inner lid defines an opening in said enclosing structure of said button tunnel, and said outer lid includes a tab that extends through said opening in said enclosing structure and into engagement with said portion of said button disposed between said first and second sliding arms and within said enclosing structure when said outer lid is in said locked position.

3. A drink bottle and lid, comprising:

a bottle having a mouth with a lid engaging structure;

a removable lid having a cooperating engaging structure for selective engagement with the lid engaging structure of said bottle;

said removable lid including an inner lid and an outer lid, said inner lid including said cooperating engaging structure, said inner lid defining a button tunnel and a spout opening, said inner lid including a first hinge portion;

said outer lid including a second hinge portion for pivoting engagement with said first hinge portion so that said outer lid is pivotable relative to said inner lid between an open position and a closed position;

a button mounted within said button tunnel of said inner lid so as to be movable between a lock position and an unlock position;

a locking tab extending from said outer lid, said locking tab engaging said button when said outer lid is in said closed position and said button is in said lock position, said locking tab being disengaged from said button when said button is moved to said unlock position;

a drink spout mounted in said spout opening of said inner lid, said drink spout extending from said inner lid at a position to permit a user to drink fluid contained within the bottle from the drinking tube when said outer lid is in the open position, said outer lid covering said drink spout when said outer lid is in said closed position; and a bail handle mounted on said outer lid and pivotable between a stowed position and a deployed position;

wherein said first and second hinge portions include hinge pins and hinge bearings, said hinge bearings including channels through which said hinge pins move when said when the outer lid is moved beyond a fully open position so as to release said first and second hinge portions from one another.

4. A drink bottle and lid as claimed in claim 3, wherein said hinge pins are of a generally cylindrical shape and each have an angled end surface.

5. A drink bottle and lid as claimed in claim 4, wherein said hinge pins are encircled by a recess channel in one of said first and second hinge portions having said hinge pins.

6. A drink bottle and lid as claimed in claim 1, wherein said outer lid includes a recess channel, and wherein said bail handle fits into said recess channel in said outer lid when in a stowed position and extends from said recess channel when in an extended position.

7. A drink bottle and lid, comprising:

a bottle having a mouth with a lid engaging structure;

a removable lid having a cooperating engaging structure for selective engagement with the lid engaging structure of said bottle;

said removable lid including an inner lid and an outer lid, said inner lid including said cooperating engaging structure, said inner lid defining a button tunnel and a spout opening, said inner lid including a first hinge portion;

said outer lid including a second hinge portion for pivoting engagement with said first hinge portion so that said outer lid is pivotable relative to said inner lid between an open position and a closed position;

a button mounted within said button tunnel of said inner lid so as to be movable between a lock position and an unlock position;

a locking tab extending from said outer lid, said locking tab engaging said button when said outer lid is in said closed position and said button is in said lock position, said locking tab being disengaged from said button when said button is moved to said unlock position;

a drink spout mounted in said spout opening of said inner lid, said drink spout extending from said inner lid at a position to permit a user to drink fluid contained within the bottle from the drinking tube when said outer lid is in the open position, said outer lid covering said drink spout when said outer lid is in said closed position; and a bail handle mounted on said outer lid and pivotable between a stowed position and a deployed position;

wherein said outer lid includes a recess channel, and wherein said bail handle fits into said recess channel in said outer lid when in a stowed position and extends from said recess channel when in an extended position;

wherein said bail handle is mounted in said outer lid by pivot pins, said outer lid having outwardly sloping surfaces against which said bail handle bears when said bail handle is moved beyond a fully deployed position, said outwardly sloping surfaces causing said pivot pins to disengage from said outer lid when said bail handle is pressed against said outwardly sloping surfaces with a disengaging force so that said bail handle disengages from said outer lid.

8. A drink bottle and lid, comprising:

a bottle having a mouth with a lid engaging structure;

a removable lid having a cooperating engaging structure for selective engagement with the lid engaging structure of said bottle;

said removable lid including an inner lid and an outer lid, said inner lid including said cooperating engaging structure, said inner lid defining a button tunnel and a spout opening, said inner lid including a first hinge portion;

said outer lid including a second hinge portion for pivoting engagement with said first hinge portion to form a hinge so that said outer lid is pivotable relative to said inner lid between an open position and a closed position;

a button mounted within said button tunnel of said inner lid so as to be movable between a lock position and an unlock position;

a locking tab extending from said outer lid, said locking tab engaging said button when said outer lid is in said closed position and said button is in said lock position, said locking tab being disengaged from said button when said button is moved to said unlock position;

a drink spout mounted in said spout opening of said inner lid, said drink spout extending from said inner lid at a position to permit a user to drink fluid contained within the bottle from the drinking tube when said outer lid is in the open position, said outer lid covering said drink spout when said outer lid is in said closed position; and a bail handle mounted on said outer lid and pivotable between a stowed position and a deployed position;

wherein said hinge includes two spaced hinge bearings on said outer lid for engaging two hinge mounts on said inner lid, and further comprising a curved cover between said hinge bearings, said curved cover blocking access to a space between said two hinge mounts by a user's finger.

9. A drink bottle and lid, comprising:

a bottle having a mouth with a lid engaging structure;

a removable lid having a cooperating engaging structure for selective engagement with the lid engaging structure of said bottle;

said removable lid including an inner lid and an outer lid, said inner lid including said cooperating engaging structure for engagement with said bottle, said inner lid and said outer lid being selectively securable to one another in a closed position, said inner lid defining a spout opening;

a drink spout mounted in said spout opening of said inner lid, said drink spout extending from said inner lid at a position to permit a user to drink fluid contained within the bottle from the drinking tube when said outer lid is in an open position, said outer lid covering said drink spout when said outer lid is in said closed position;

said inner lid including a first hinge portion, said outer lid including a second hinge portion for pivoting engagement with said first hinge portion so that said outer lid is pivotable relative to said inner lid between said open position and said closed position, said outer lid being securable in said open position, said outer lid being movable beyond said open position to cause release of said first and second hinge portions from one another; and one of said first and second hinge portions including hinge pins and the other of said first and second hinge portions defining openings into which said hinge pins are disposed for pivoting movement, said other of said first and second hinge portions define channels extending from said openings through which said hinge pins move during the release of the first and second hinge portions as said outer lid is moved beyond said open position.

10. A drink bottle and lid as claimed in claim 9, wherein said inner lid includes a beveled surface adjacent said first hinge portion, said outer lid bearing against said beveled surface when said outer lid is moved beyond said open position so as to cause said first and second hinge portions to disengage from one another.

11. A drink bottle and lid as claimed in claim 9, further comprising:

a bail handle mounted on said outer lid and pivotable between a stowed position and a deployed position;

pins extending between said bail handle and said outer lid on which said bail handle pivots between said stowed position and said deployed position;

a disengagement surface on said outer lid against which said bail handle bears when moved beyond said deployed position, said disengagement surface causing said pins to disengage from between said bail handle and said outer lid when a disengaging force is exerted on said bail handle.

12. A drink bottle and lid as claimed in claim 11, further comprising: a retainer projection that engages a retainer indentation as between said outer lid and said bail handle when said bail handle is in a stowed position to retain said bail handle in said stowed position, said retainer projection being disengaged from said retainer indentation when said bail handle is in said deployed position.

13. A drink bottle and lid as claimed in claim 9, wherein said hinge pins each have an end surface disposed at an angle to an axis of said pins.

14. A drink bottle and lid, comprising:

a bottle having a mouth with a lid engaging structure;

a removable lid having a cooperating engaging structure for selective engagement with the lid engaging structure of said bottle;

said removable lid including an inner lid and an outer lid, said inner lid including said cooperating engaging structure for engagement with said bottle, said inner lid and said outer lid being selectively securable to one another in a closed position, said inner lid defining a spout opening;

a drink spout mounted in said spout opening of said inner lid, said drink spout extending from said inner lid at a position to permit a user to drink fluid contained within the bottle from the drinking tube when said outer lid is in an open position, said outer lid covering said drink spout when said outer lid is in said closed position;

said inner lid including a first hinge portion, said outer lid including a second hinge portion for pivoting engagement with said first hinge portion so that said outer lid is pivotable relative to said inner lid between said open position and said closed position; and a bail handle mounted on said outer lid and pivotable between a stowed position and a deployed position;

pins extending between said bail handle and said outer lid on which said bail handle pivots between said stowed position and said deployed position; and a disengagement surface on said outer lid against which said bail handle bears when moved beyond said deployed position, said disengagement surface causing said pins to disengage from between said bail handle and said outer lid when a disengaging force is exerted on said bail handle.

15. A drink bottle and lid as claimed in claim 14, wherein said inner and outer lids are selectively detachable from one another by moving said outer lid beyond a fully open position and are selectively reattachable by snapping hinge parts together.

16. A drink bottle and lid as claimed in claim 14, further comprising:

a push button on said inner lid that is operable to release said outer lid from a closed position over the drink spout; and a tunnel structure on said inner lid within which said push button is mounted.

* * * * *